US005390747A

United States Patent [19]

Gu et al.

[11] Patent Number: 5,390,747

[45] Date of Patent: Feb. 21, 1995

[54] WELL RIG LIFT SYSTEM AND A HYDRAULIC ENERGY-STORING WELL RIG LIFT SYSTEM

[75] Inventors: Xinyi Gu; Yunan Wang; Wei Pan; Guihua Luan; Dongchang Sun; Zhian Liu; Ruji Bing, all of Dongying, China

[73] Assignee: Drilling Technology Research Institute of Shengli Oilfield, China

[21] Appl. No.: 990,663

[22] Filed: Dec. 14, 1992

[51] Int. Cl.[6] ..... E21B 19/08

[52] U.S. Cl. ..... 173/4; 173/11; 173/147; 173/151

[58] Field of Search ..... 173/4, 10, 11, 151, 173/147; 254/93 R

[56] References Cited

U.S. PATENT DOCUMENTS

| | | | |
|---|---|---|---|
| 2,790,340 | 4/1957 | Cross | 173/4 |
| 3,648,783 | 3/1972 | Lackey | 173/4 |
| 3,659,655 | 5/1972 | Gyongyosi | 173/4 |
| 3,670,826 | 6/1972 | Hanson et al. | 173/4 |
| 3,734,202 | 5/1973 | Gyongyosi | 173/4 |
| 3,804,183 | 4/1974 | Duncan et al. | 173/4 |
| 3,823,784 | 7/1974 | Feucht | 173/11 |
| 3,986,546 | 10/1976 | Bender . | |
| 4,534,419 | 8/1985 | Vural | 173/10 |

*Primary Examiner*—Scott A. Smith

*Attorney, Agent, or Firm*—Merchant, Gould, Smith, Edell, Welter & Schmidt

[57] ABSTRACT

A well rig lifting system and a hydraulic energy-storing well rig lifting system, wherein a high pressure energy-storing cylinder and a composite cylinder or cylinder group are used to carry out the lifting and lowering operations. During the lifting operation, a power machine under a substantially constant load continuously pumps oil to the energy-storing cylinder, and communication relationships of the energy-storing cylinder with various chambers of the composite cylinder or cylinder group is selected to provide an appropriate lifting force to lift the pipe string. Therefore, the installed capacity of the power machine can be reduced to $\frac{1}{3}$–$\frac{1}{4}$ of that in a conventional lifting system. During the lowering operation, communication relationships of the energy-storing cylinder with various chambers of the composite cylinder or cylinder group is selected to provide an appropriate lifting force grade less than the gravity of the pipe string, so as to utilize the energy-storing cylinder to recover the potential energy released during the lowering of the pipe string. The recovered energy can then be used to carry out auxiliary operations during the lowering operation, and therefore no power machine is needed to run. The recovered energy can also be used in power generation, heating, etc.

30 Claims, 7 Drawing Sheets

WELL RIG LIFT SYSTEM AND A HYDRAULIC ENERGY-STORING WELL RIG LIFT SYSTEM

BACKGROUND OF THE INVENTION

The present invention relates to well rigs such as drilling rigs and service rigs, and particularly to a hydraulic energy-storing well rig lift system, wherein a high pressure energy-storing system and a composite cylinder or a cylinder group are used to carry out the lifting operation and to recover the potential energy of pipe string released during the lowering operation.

At present, oil well rigs lift system (service rigs and drilling rigs lift system) are very much the same. Most of them comprise power machines, driving devices, gear boxes, derricks, crown blocks, travelling blocks, and draw works. In the operation of the well rigs, tubings or drill pipes up to tens of hundreds of tons and with length up to thousands of meters are lifted up and laid down once and again and a large amount of fuel is consumed.

During the lifting operation, when a pipe or pipestand is lifted, the actual lifting time takes only $\frac{1}{3}$–$\frac{1}{4}$ of the whole process, and the rest is for some auxiliary operations such as unloading a single pipe, placing the unloaded pipes to a proper position, etc. However, during the lifting operation, a great deal of work is done in a short duration, and therefore the installed capacity of the well rig power machine must be large enough to meet the demand for lifting. And a power machine with large installed capacity will consume a large amount of fuel even during idling or near idling in the auxiliary operations.

During the lowering operation, although the descending of the pipe string will release a large amount of potential energy, the power machine cannot stop running and still consumes a lot of fuel. And not only the released potential energy of pipe string is unable to be recovered for use but it is also necessary to control the lowering operation by means of braking and other methods which consume large energy, otherwise an accident may occur.

The hydraulic technique now is very popular in well rigs. Hydraulic elements and apparatuses, such as cylinders, valves, pumps, oil tanks and compensators, etc., are widely employed in various rigs, drills and drifters for controlling, tool feeding, load indicating and for compensating purposes.

Although hydraulic systems employed in many kinds of drilling tools are known, it is not known how to store the energy of a power machine or how to store the potential energy of the pipe string released during lowering operation, and how to reuse the stored-energy as desired, which are essential matters of the present invention. For instance, U.S. Pat. No. 3,986,564 issued to Bender on Oct. 19, 1976, discloses a hydraulic well rig utilizing hudraulic cylinders to carry out the lifting operations so as to eliminate winches, driving devices and crown blocks, but the above-mentioned energy storage method is not taught in this Patent.

SUMMARY OF THE INVENTION

It is a principal object of the present invention to provide a hydraulic energy-storing well rig system, wherein a high pressure energy-storing system and a composite cylinder or a cylinder group are used to carry out the lifting and lowering operations so as to save a large amount of energy or fuel.

It is another object of the present invention to provide a well rig lift system, wherein the installed capacity of its power machine will be only $\frac{1}{3}$ to $\frac{1}{4}$ of the conventional installed capacity.

It is a further object of the present invention to provide a well rig lift system wherein when a pipe or stand is lifted the power machine will be working continuously Under a substantially constant load and during the auxiliary operations the energy will be stored for lifting a next pipe or pipe stand.

It is further object of the present invention to provide a well rig lift system which can utilize the energy of a high pressure energy-storing cylinder and can control the force grade during the lifting and lowering operation by a composite cylinder or a cylinder group.

It is still further object of the present invention to provide a well rig lift system which can utilize a high pressure energy-storing cylinder and a composite cylinder or a cylinder group to recover the potential energy of pipe string released during the lowering operation.

It is still further object of the present invention to provide a well rig lift system in which no power machine is needed during the lowering operation.

The present invention provides a hydraulic energy-storing well rig lift system, comprising a hydraulic source including a power machine, a hydraulic pump, oil tanks and oil pipelines, an energy-storing system including a high pressure energy-storing cylinder and a high pressure nitrogen or air vessel, a composite cylinder or a cylinder group mounted on a rig frame used to drive a pair of traction ropes, a normal pressure top oil tank disposed above the composite cylinder or the cylinder group, and comprising further a pilot valve assembly used to control inter-communication between chambers of the composite cylinder or of the cylinder group with the high pressure energy-storing cylinder and the normal pressure top oil tank, so as to select a proper lifting force larger than the gravity of the pipe string to carry out the lifting operations by utilizing the high pressure oil in the energy-storing cylinder, and during the lowering operation to select a proper lifting force less than the gravity of the pipe string to press the high pressure oil back to the energy-storing cylinder to recover the potential energy released during the lowering operation.

The high pressure energy-storing cylinder can be a piston cylinder in communication with a high pressure nitrogen or air tank, the high pressure gas tank maintains a constant pressure in the piston cylinder and thus the composite cylinder or cylinder group can provide different lifting forces under such a constant hydraulic working pressure.

During the lifting operation, the power machine (an engine or an electric motor) actuates the hydraulic oil pump to pump oil liquid continuously to the energy-storing cylinder for accumulating high pressure hydraulic oil even during auxiliary operations. Therefore it almost does not idle and can work always under a substantially constant load and thus the problem of energy waste during auxiliary operations will be solved. During the actual lifting operation, the accumulated high pressure hydraulic oil is led to the composite cylinder or cylinder group to lift the pipe string instead of lifting by power machine as the conventional mode. Therefore the installed capacity of the power machine in the well rig of the present invention is only $\frac{1}{3}$ to $\frac{1}{4}$ of that in a conventional well rig with nearly the same load capacity and lift speed.

During the lifting operation, a proper force grade is selected by the pilot valve assembly controlling the inter-combination between chambers of the composite cylinder or cylinder group and the high pressure energy-storing cylinder and the normal pressure top oil tank, so that a lifting force larger than the gravity of the pipe string is determined to have the pipe string lifted. The high force grade is used for heavy load and more high pressure hydraulic oil is consumed, the low force grade is used for light load and less high pressure hydraulic oil is consumed, so that energy is rationally consumed.

During the lowering operation, sometimes it is not necessary to start the power machine. It is only necessary to select a proper force grade to provide a lifting force less than the gravity of the pipe string and the pipe string will then be lowered. At the same time, a portion of hydraulic oil will be pressed back to the high pressure energy-storing cylinder. The larger the pipe string weight is, the more the high pressure oil will be pressed back, so that energy released by the lowering pipe string is recovered. This recovered energy not only can be used for the lowering operation without running of the power machine but also can be used to do some other work, such as to charge batteries, to drive fans and air-conditioners.

Moreover, the well rig of the present invention provides for an easier braking operation, since the major portion of the energy released by the pipe string has been recovered.

Still another advantage of the present invention is that, after closing the valve leading to the energy-storing cylinder which accumulates high pressure hydraulic oil, a hydraulic oil pump with a characteristic of small displacement at high pressure will supply oil directly to the composite cylinder or cylinder group and obtain a very large lifting force and a very, very low lifting speed, which is very useful during the lifting operations in case of the pipe string being obstructed and the lifting force being inadequate.

The present invention provides a composite cylinder consisting of a piston cylinder and a plunger cylinder, the piston cylinder has an upper chamber and a lower chamber with their respective oil inlets, the plunger has a plunger chamber with its oil inlet, therein a piston rod of the piston cylinder is connected fixedly with the plunger. Such a composite cylinder can effectively provide a plurality of force grades. A cylinder group can also be provided as a replacement of the composite cylinder to insure the necessary number of force grades for selection.

The above-mentioned and other objects, features and advantages of the present invention will be more apparent with the following detailed description of the embodiments with reference to the accompanying drawings, in which, FIG. 1 is a side view of one embodiment (a service rig) of the present invention;

Figure 9:
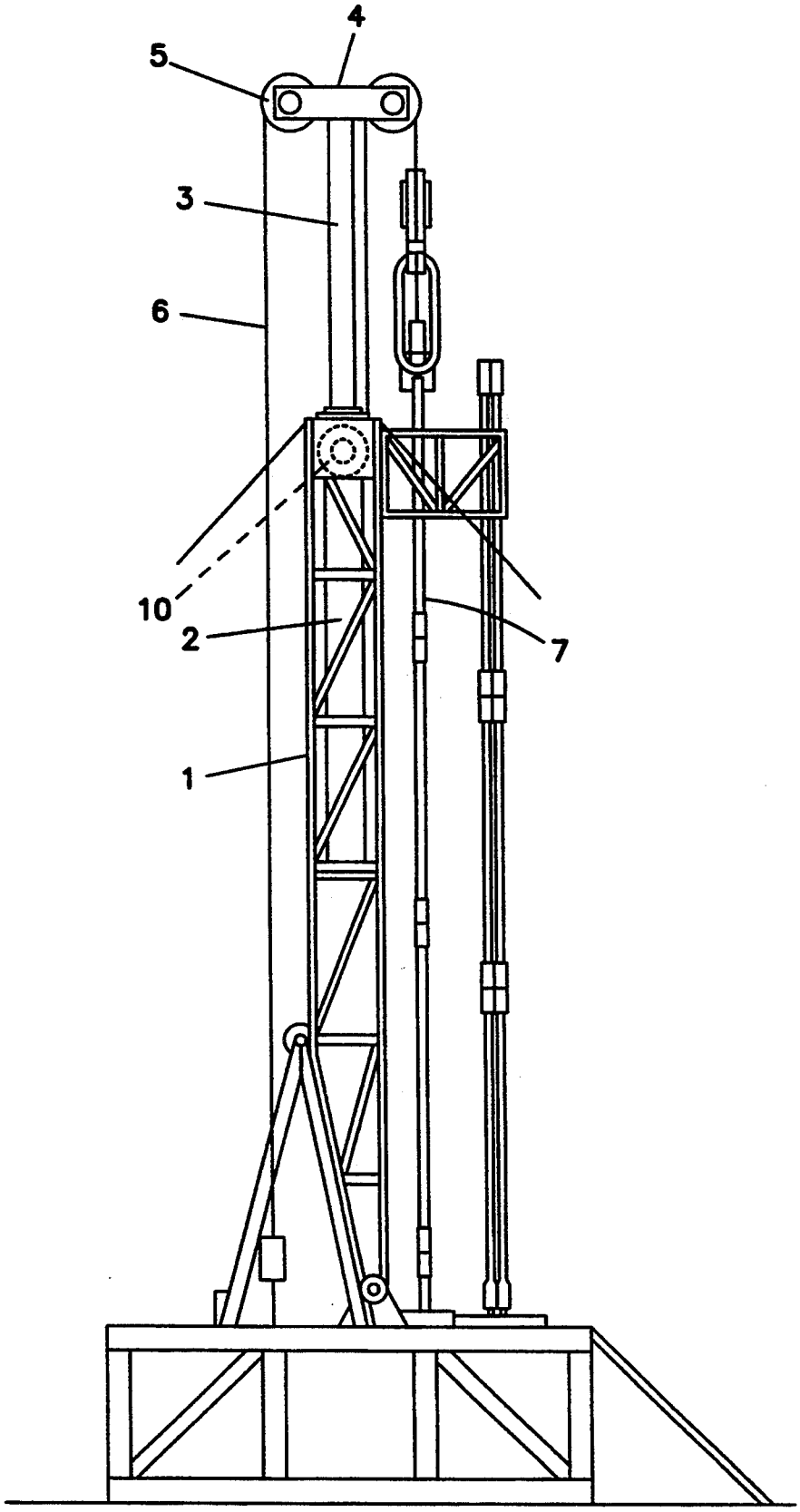

FIG. 8*a*–8*d* show schematic arrangement modes of cylinders with different numbers of the cylinder group;

FIG. 9 is a side view of another embodiment (drilling rig) of the present invention.

DETAILED DESCRIPTION OF THE PREFERRED EMBODIMENT

Figure 1:
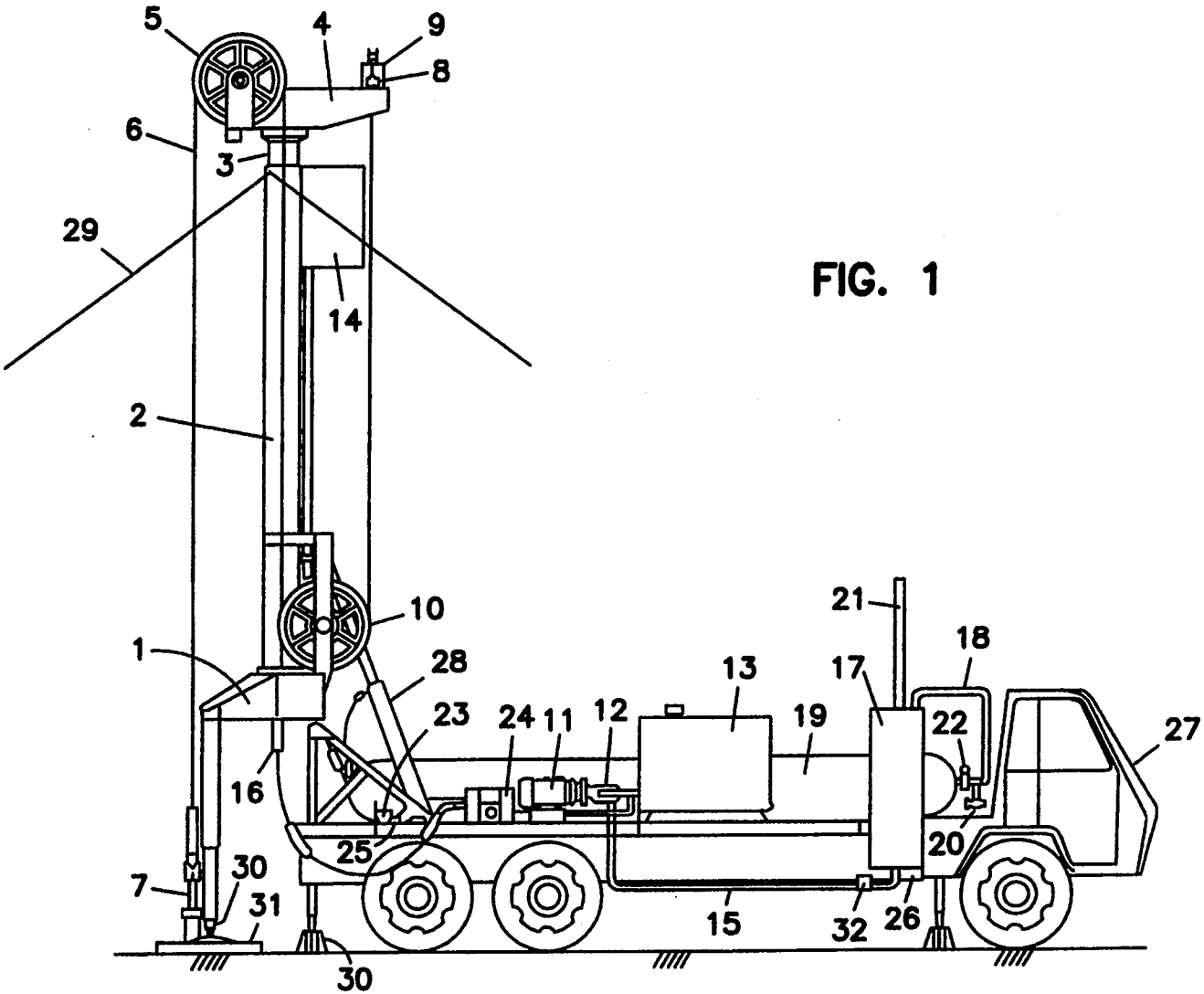
Figure 2:
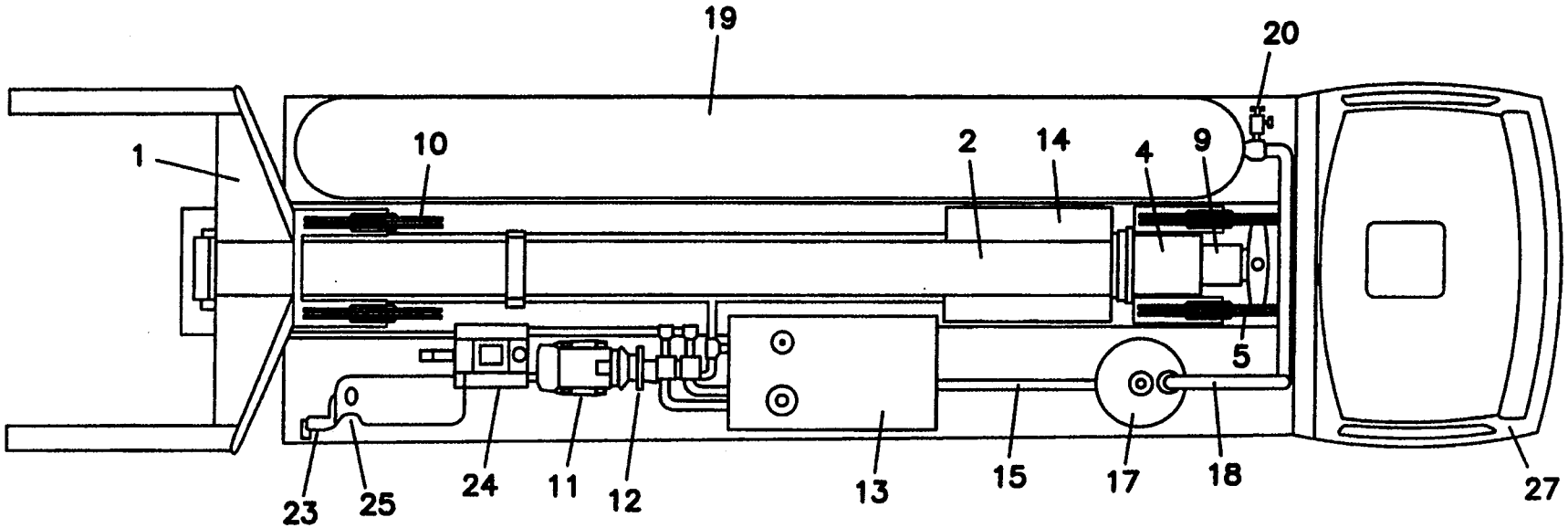
FIG. 2 is a top view of the service rig in FIG. 1 in transportation state.

FIG. 1 and FIG. 2 show an embodiment of the present invention, wherein the well rig is a service rig. It has a hydraulic source, a specific and perfect energy-storing system, a lift-length increasing system and a measuring and control system.

The hydraulic source is conventional, consisting of one or a few hydraulic oil pumps 12, one or a few power machines 11 (engine or electric motor), an oil tank 13, and corresponding oil pipelines 15. The movable part of the pipelines 15 are high pressure flexible hoses 16.

The energy-storing system comprises an energy-storing cylinder 17 to accumulate high pressure hydraulic oil. Said energy-storing cylinder 17 and high pressure nitrogen or air vessel 19 are in communication with a gas pipe 18 to maintain a substantially constant high pressure in the energy-storing cylinder 17. The vessel 19 usually contains nitrogen gas and is fitted with charging equipment for nitrogen gas. The cylinder 17 has an oil level indicator 21 to indicate the amount of high pressure oil in the cylinder 17.

Figure 3:
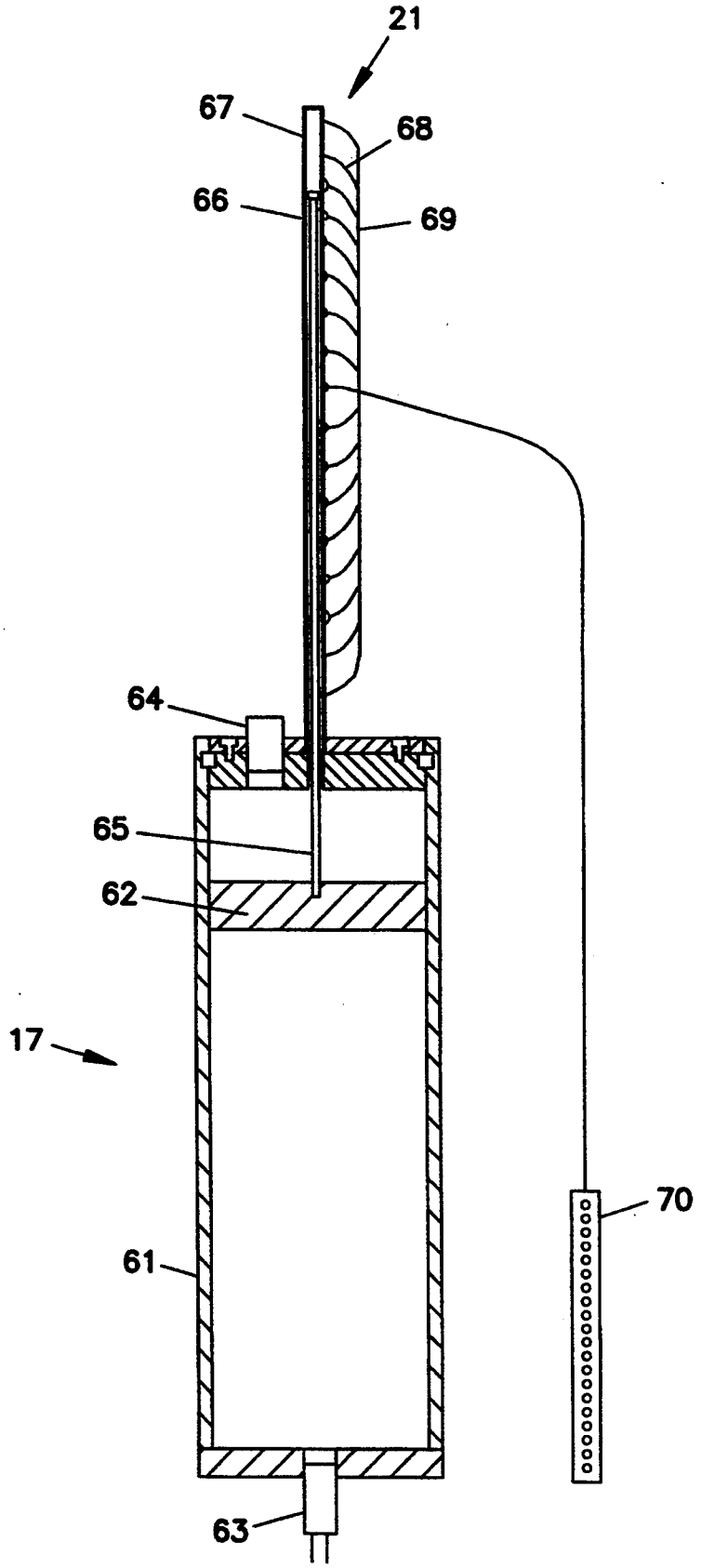
FIG. 3 is a sectional view of a high pressure energy-storing cylinder used in the present invention.

As shown in FIG. 3, a floating piston 62 in the cylinder shell 61 of the high pressure energy-storing cylinder 17 floats up and down following the amount of high pressure hydraulic oil in the cylinder 17. The upper chamber in the cylinder shell 61 is a gas chamber. An inlet 64 to the gas chamber is located at the upper end of the cylinder 17 and in communication with the vessel 19. The lower chamber is an oil chamber. An oil inlet 63 is communicated with the hydraulic system. Both said cylinder 17 and the high pressure gas vessel 19 have sufficiently large capacity. In the center of the piston 62 is a slender connecting rod 65 sticking out of the cylinder body with a magnet 66 mounted on its top end. The magnet 66 and the connecting rod 65 can move up and down within a copper tube 67. Outside the copper tube 67 along its tube wall are disposed a string of magnetic switches 68. Each magnetic switch 68 is connected to a small lamp 70 or to a relay by wire 69. The magnetic switch 68 adjacent to the magnet 66, by closing the electric circuit, will light the connected small lamp or close the relay, so as to indicate or control the level of the accumulated oil liquid.

The present invention also comprises a composite cylinder or a cylinder group 2 which is mounted on the rig frame 1. The cylinder group consists of one or more piston cylinders, plunger cylinders, composite cylinders or combinations thereof. The composite cylinder per se consists of a piston cylinder and a plunger cylinder and has three chambers. The structure will be described in detail later.

Each piston cylinder or plunger cylinder in the cylinder group includes a stationary cylinder body connected to the rig frame 1 and a moving part (a piston rod or a plunger 3) extending upward from the cylinder body. Each piston cylinder has an upper chamber and a lower chamber defined by a piston, while each plunger cylinder has only a plunger chamber (a lower chamber). All the piston cylinders or plunger cylinders are conventional in structure and detailed illustration is omitted.

All the chambers are in intercommunication respectively and selectively with a high pressure energy-storing cylinder 17 and a normal pressure top oil tank 14 by pipelines or conduits.

All the piston cylinders, plunger cylinders and composite cylinders are mounted vertically and symmetrically on the rig frame 1. The moving part (the piston rod or the plunger rod 3) is connected to a travelling beam 4, while the stationary part (cylinder body) of each of them is connected to the rig frame 1.

The number of cylinders in the cylinder group 2 is odd so that the cylinders can be arranged symmetrically to supply an even force to the travelling beam 4. This will be further described with reference to FIGS. 8*a*–8*d*.

The ends of a pair of steel traction ropes 6 are connected on the travelling beam 4, and the other ends, extending around the fixed sheaves 10 and the travelling sheaves 5, are connected to a pipe string lifter for lifting the pipe string 7. The lift-length increasing system, composed of the travelling beam.4, the travelling sheaves 5, the fixed sheaves 10 and the traction ropes 6, enables the composite cylinder or the cylinder group 2 to increase its lift length by 3 times. An adjusting screw 8 is used to adjust the traction ropes 6 to even up the load distribution. A weight indicator sensor 9 is connected to the end of the wire ropes 6.

It is very important to increase the lift-length by 3 times or more, since the speed available for the composite cylinder or cylinder group is far less than the lifting speed demanded for the pipe string. Besides, if the piston rod or plunger 3 is slender and long, it will not be kept stable under a large load.

In order to fill up all the low pressure chambers of the composite cylinder or cylinder group 2 with hydraulic oil, the normal pressure top oil tank 14 is necessary. All of the hydraulic oil, before draining back to the oil tank 13, first flows into the top oil tank 14. Only when the top oil tank is full, can the oil flow back to the oil tank 13. Certainly, it is also possible to fill the top oil tank 14 by a pump. In this way, no matter what the condition may be, none of the low pressure chambers of the composite cylinder or cylinder group 2 will be empty.

The rig frame 1, as well as the composite cylinder or cylinder group 2, the travelling beam 4, the sheaves 5, 10, the traction ropes 6, etc., which are mounted on the frame, are lifted to a vertical position or laid down to a horizontal position by a rack-lift hydraulic cylinder 28.

The composite cylinder or cylinder group 2 and the rig frame 1 are kept stable by guys 29. Jacks 30 and larger jack base plates 31 are mounted to insure that the composite cylinder or cylinder group 2 can be adjusted to a vertical position and have a sufficient supported area.

There are also some measuring instruments and control means, such as an oil level indicator 21, pressure gauges 22, a weight indicator 9, a manual pilot valve assembly 23, a hydraulic valve assembly 24, a choke valve assembly 25, and a release valve 26, etc. The pilot valve assembly 23 may also be magnetic or pneumatic pilot valves.

All the above-mentioned systems, installations and instruments are mounted on a vehicle 27.

The upper and lower chambers of the composite cylinder or cylinder group 2 are communicated respectively and selectively with the high pressure energy-storing cylinder 17 or the normal pressure top oil tank 14 through the hydraulic valve assembly 24. The chambers leading to the cylinder 17 are high pressure chambers, while the remaining chambers, leading to the top oil tank 14, are low pressure chambers. The different handle positions of the manual pilot valve assembly 23 determine the opening and closing of various valves in the hydraulic valve assembly 24, so as to determine the communicating passages of all the upper and lower chambers of the composite cylinder or cylinder group 2.

If an upper chamber is a high pressure chamber, the composite cylinder or cylinder group 2 gives a force downward, namely the lifting force is negative. If a lower chamber is a high pressure chamber, the force of the composite cylinder or cylinder group 2 is upward, namely the lifting force is positive. Various different communicating relationships give different lifting forces or different grades of lifting force, namely "force grades".

During the lifting operation, the power machine 11 actuates the hydraulic pump 12 to pump high pressure oil from oil tank 13 through stop valve 32 into the energy-storing piston cylinder 17. Meanwhile, a proper lifting force larger than the gravity of the pipe string is selected for the composite cylinder or cylinder group 2 and the energy of high pressure oil in the piston cylinder 17 is utilized to lift up the pipe string 7.

During this process, the power machine 11 can work continuously under a substantially constant load, namely to pump oil uninterruptedly to the cylinder 17, and to do so even during auxiliary operations. Therefore, the waste of energy resulting from any idling of the power machine during auxiliary operations will not occur as is the case for conventional modes, in addition, the installed capacity of the power machine 11 can be reduced greatly, requiring only $\frac{1}{3}$ to $\frac{1}{4}$ as that required of the conventional mode, and hence an electric motor can be used to replace a diesel engine. Generally, the electric source, in any oil well site is sufficient to actuate electric motors of such rated capacity.

Of course, if the oil level is too high in the cylinder 17, oil supply must be decreased or stopped.

When lifting operation is just started, the pipe string 7 is long and heavy, and the lifting of one pipe will consume a large amount of the high pressure oil. As the lifting operation goes on, the pipe string 7 becomes shorter and shorter, and lighter and lighter in weight, and the consumption of the high pressure oil for lifting each pipe becomes less and less. In order to rationally use the hydraulic pump 12 and the electric motor 11, two or more hydraulic oil pumps 12 or electric motors 11 may be considered, or speed adjustable motors 11 may be provided.

During the lowering operation of the pipe string 7, a proper force grade is selected for the composite cylinder or cylinder group 2 so that the lifting force is less than the gravity of the pipe string, and the pipe string will be lowered down and will press a portion of oil in the high pressure chambers back to the high pressure energy-storing piston cylinder 17, so as to recover the potential energy of pipe string 7 released during the lowering operation.

As the lowering of the pipe string goes on, the oil level in the energy-storing cylinder 17 will be higher and higher, since more and more oil is pressed back from the composite cylinder or cylinder group 2. Under such a condition, the accumulated high pressure oil can be let out for use, or the surplus high pressure hydraulic oil is drained back to the oil tank 13.

During the lowering operation, no power machine is needed to run.

Generally, the lifting force is graded or stepped, while the weight of the pipe string and the desired lifting speed and acceleration vary under different conditions. In order to meet such a requirement, a choke (brake) valve assembly 25 is also provided to overcome the deficiency that the lifting force is not steplessly variable. The choke valve assembly 25 can also cut off oil flow passage so as to brake and to insure safety.

Figure 4:
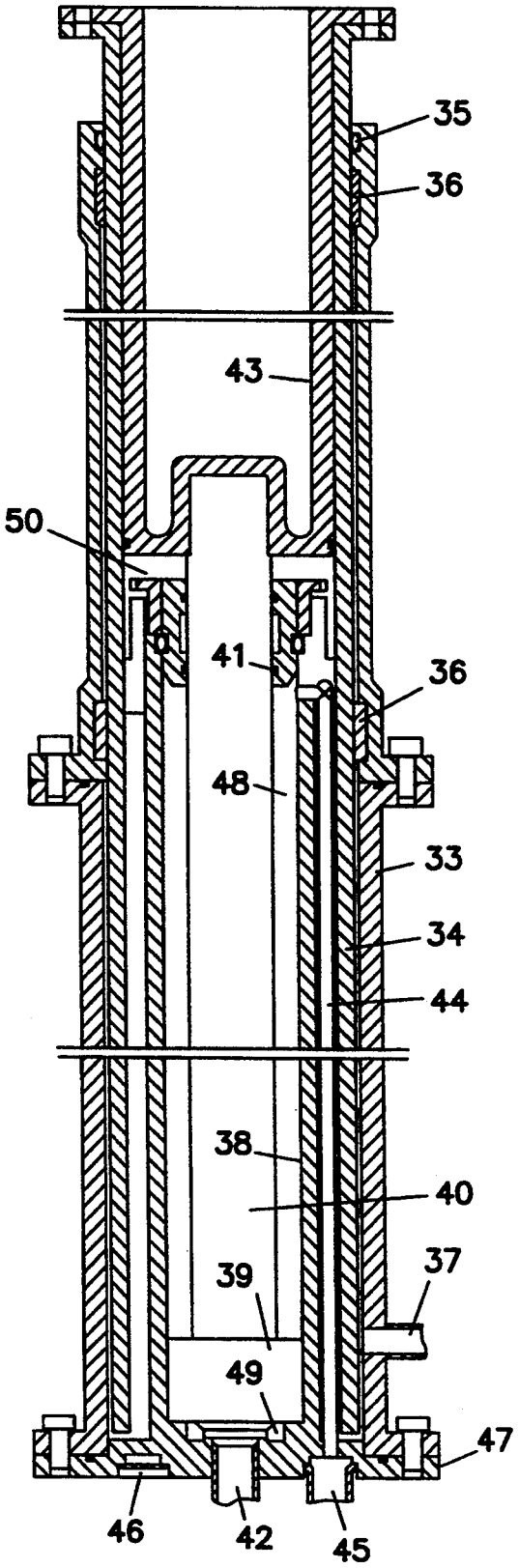
FIG. 4 is a sectional view of a composite cylinder used in the present invention.

The cylinder group 2 can be composed of a plurality of piston cylinders, plunger cylinders and composite cylinders, or of a combination thereof. FIG. 4 shows one form of composite cylinder which comprises an internal piston cylinder and an external plunger cylinder. The internal piston cylinder consists of a cylinder shell 38, a piston 39, a piston rod 40, piston rod seals 41 and oil inlets 45, 42. The external plunger cylinder consists of a cylinder shell 33, a plunger 34, a plunger seals 35, guiding bushings 36 and an oil inlet 37.

A plunger .chamber 50 is communicated with the inlet 37. A lower chamber 49 is connected with the inlet 42. The inlet passage of an upper chamber 48 of the piston cylinder is rather complicated: Oil from the oil inlet 45 enters an annular passage on a flange 47 at the cylinder bottom and then ascends upward through several ducts 44 and enters into the upper chamber 48. These ducts 44 are distributed around the outside periphery of the piston cylinder shell.

The composite cylinder has an internal guiding means composed of guide bushings 36 spaced apart from each other, so as to insure good guidance, therefore, no other guide is required. The piston rod 40 and plunger 34 are joined together with a connecting rod 43.

In the following example for reference, it can be seen how the different lifting force grades are obtained by this composite cylinder. Wherein:

| | |
|---|---|
| Area of the piston cylinder upper chamber 48: | 154 $cm^2$ |
| Area of the piston cylinder lower chamber 49: | 314 $cm^2$ |
| Area of the plunger climber 50: | 649 $cm^2$ |

If the hydraulic working pressure is 10 MPa, then, the lifting force of chamber 48 when filled up with high pressure hydraulic oil is −154,000 KN or −15t;

the lifting force of chamber 49 when filled up with high pressure hydraulic oil is +314,000 KN or 30.7t; and the lifting force of chamber 50 when filled up with high pressure hydraulic oil is +649,000 KN or 63.6t.

The different communication conditions give different lifting forces and force grades as shown in the following table:

| | Pilot valve assembly handle position | | | | | | | |
|---|---|---|---|---|---|---|---|---|
| | 1 | 2 | 3 | 4 | 5 | 6 | 7 | 8 |
| Communication of chamber 48 | ▩ | 0 | ▩ | 0 | ▩ | 0 | ▩ | 0 |
| Communication of chamber 49 | 0 | 0 | ▩ | ▩ | 0 | 0 | ▩ | ▩ |
| Comunication of chamber 50 | 0 | 0 | 0 | 0 | ▩ | ▩ | ▩ | ▩ |
| Lifting force grade | *−1 | 0 | 1 | 2 | 3 | 4 | 5 | 6 |
| Cylinder lifting force * (t) | *−15 | 0 | +15.7 | +30.7 | +48.6 | +63.6 | +79.3 | +94.3 |
| Lifting force after lift-length increased by 3 times * (t) | *−5 | 0 | +5.2 | +10.2 | +16.2 | +21.2 | +26.4 | +31.4 |

wherein: ▩ showing a communication of the chamber with high pressure oil;
showing a communication of the chamber with normal pressure oil;
* Here the weight of the plunger, the piston rod, various sheaves, the travelling beam, and any frictional resistance are not considered;
* The negative force grade is used in certain special cases only, for instance when there is pressure in the well, and oil pipes have to be pressed in by external force.

It is evident from the table, since the composite cylinder has three chambers 48, 49, 50, one composite cylinder will be able to provide a number of force grades, thus it is much more convenient and compact in structure.

Figure 5:
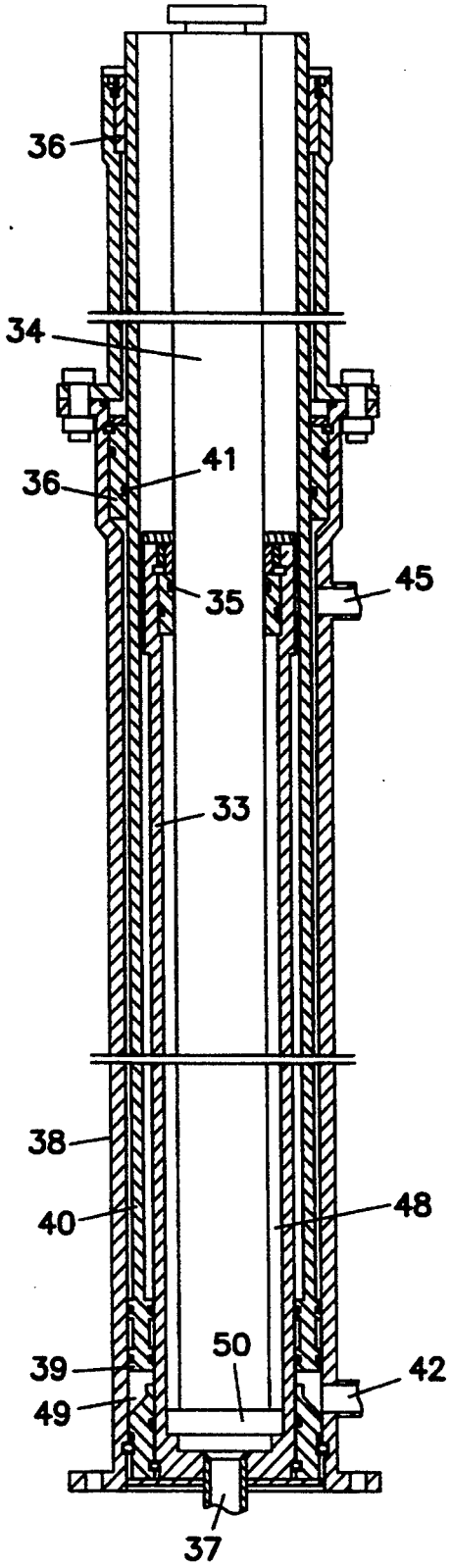
FIG. 5 is a sectional view of another composite cylinder used in the present invention.

FIG. 5 shows another form of a composite cylinder. Its difference from the composite cylinder shown in FIG. 4 lies in the fact that the plunger is in the inside and the piston cylinder is at the outside.

Of course, the internal guide means composed of two guide bushings spaced apart can also be replaced by derrick guides.

Figure 6:
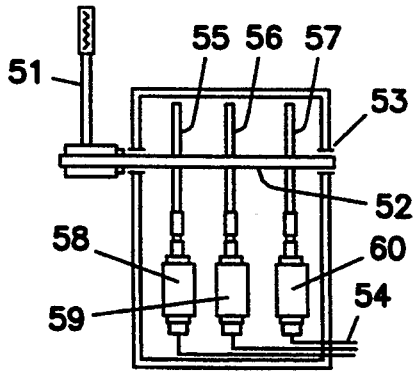
FIG. 6 shows schematically a pilot valve assembly.
Figure 7:
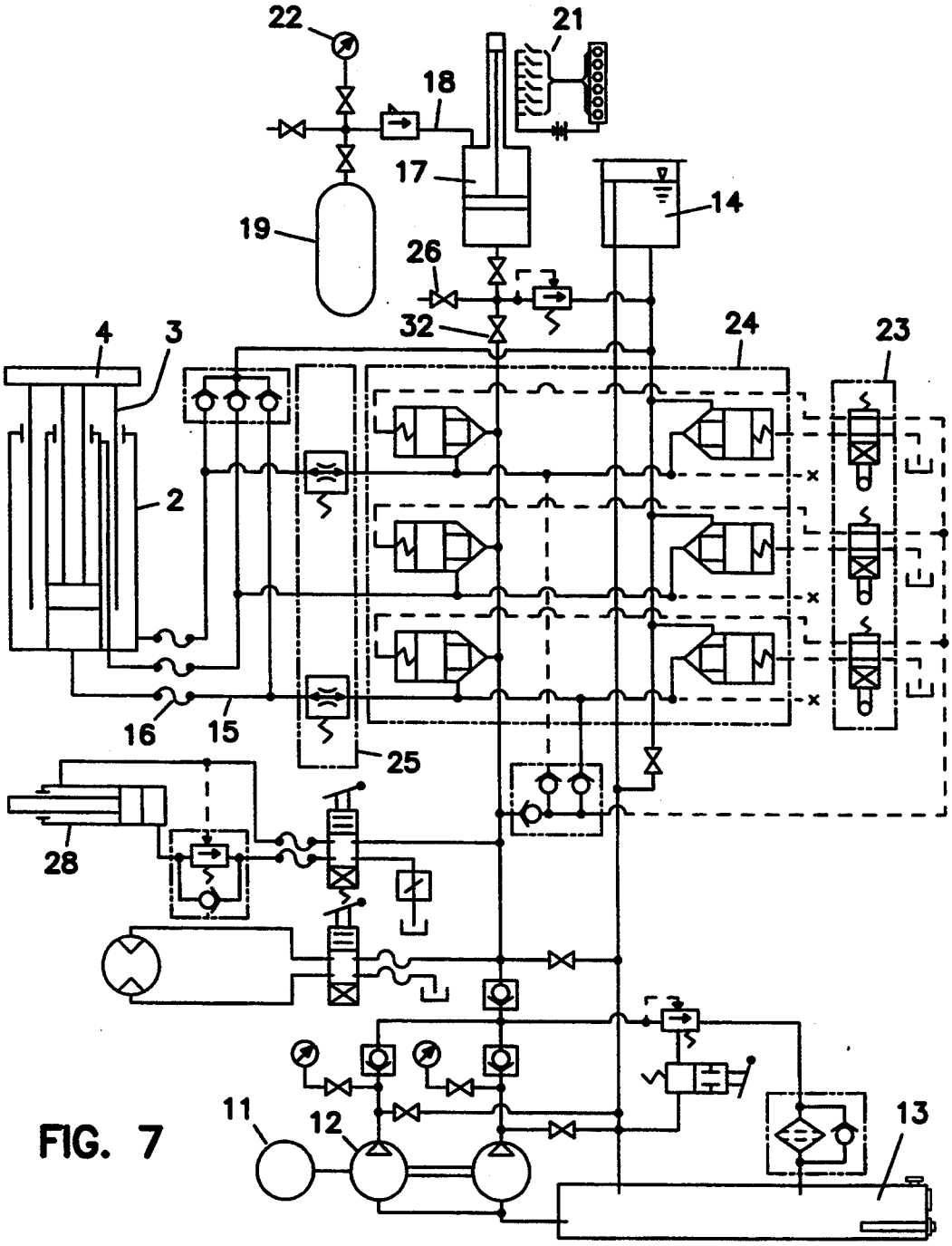
FIG. 7 is a hydraulic system diagram of said embodiment.

FIG. 6 shows the manual pilot valve assembly 23. The pilot valves 58, 59, 60 are actuated by three cams 55, 56, 57 rotated by a handle 51 mounted on a shaft 52 so that the pilot valve assembly 23 and the hydraulic valve assembly are put in communication by the oil pipeline 54. The opening and closing conditions of the hydraulic valve assembly 24 controlled by the pilot valve assembly 23 determines the communicating conditions of chambers 48, 49, 50 and thus determines the force grade of the lifting force. FIG. 7 shows a hydraulic system diagram.

Figure 8A:
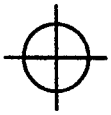
Figure 8B:
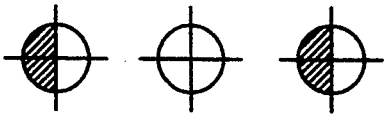
Figure 8C:
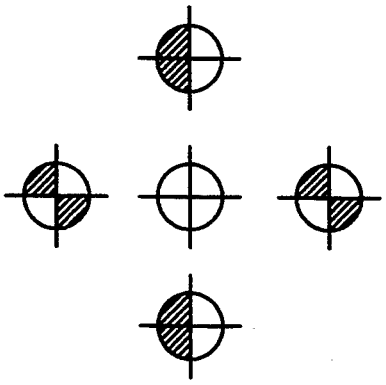

FIG. 8*a* shows only one cylinder for lifting which is a composite cylinder.

Figure 8D:
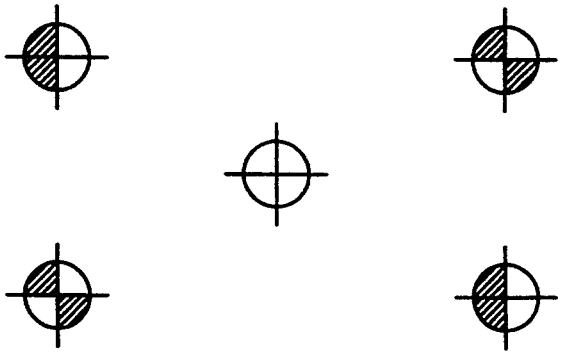

FIGS. 88*b*–8*d* show different arrangements of cylinders in a cylinder group, in which the same symbols indicate cylinders of the same type and any of them may be a piston cylinder, a plunger cylinder or a composite cylinder. It can be noted that the number of the cylinders is odd and that cylinders of the same type are symmetrically arranged relative to a central cylinder. This is to provide an even force to the travelling beam to which the moving parts in the cylinder group are connected.

The lower chambers of each pair of cylinders symmetrically-arranged to the central cylinder must be intercommunicated with each other and so do their upper chambers so that the cylinders in pair will function as one cylinder.

Ingeniously selecting the form and lift-length increasing times of the composite cylinder or cylinder group and properly designing the hydraulic source and the cross sectional area of various chambers of the cylinders will provide the ability to meet various requirements of the well rigs in loads, via a number of force grades and in speeds.

FIG. 9 shows another embodiment of the present invention, wherein the well rig is a drilling rig and the components are similar to those in FIG. 1 and are denoted by similar reference numerals.

The member to be lifted and lowered in the drilling rig is the drill pipe-stand but not the single pipe. The length of the drill pipe-stand can be over 27 m, and therefore a longer composite cylinder or cylinder group 2 and larger increasing distance time is required. As the load of the drilling rig is large, the size of the cylinder has to be increased correspondingly. As shown in FIG. 9, the ends of the pair of the traction ropes are connected to the stationary portion of the drilling rig, and the other ends pass around two travelling sheaves and one fixed sheaves, so as to increase the lift-length by a ratio of 4:1.

The rig frame 1 is a derrick 1 and stands erectly on the ground but is not mounted on the vehicle.

Since the loading and lifting forces required for a drilling rig are far larger than a service rig, more force grades are required. This problem can be solved by selecting a proper design of the cylinder group 2.

The present invention has a further advantage: When the pipe string 7 is obstructed, and the lifting force is inadequate, the stop valve 32 can be closed so that the hydraulic oil pumped out of the hydraulic oil pump is unable to enter the energy-storing cylinder 17 but able to enter directly into the composite cylinder or cylinder group 2 through the hydraulic valve assembly 24. Meanwhile the discharge capacity of the hydraulic oil pump 12 is diminished by adjustment, so as to raise the pressure of the system. (If the hydraulic oil pump 12 is a constant power pump, its discharge capacity will automatically lower after the raising of pressure, needless of any adjustment). Then, the combined lifting force of the composite cylinder or cylinder group 2 will be greatly increased, and will possibly overcome the obstruction. Certainly, the lifting speed at this moment is very low. Fortunately in time of "hard pulling" due to obstruction, low speed is required for safety.

The manual pilot valve assembly 23 can also be replaced by a magnetic or pneumatic pilot valve assembly.

We claim:

1. A hydraulic energy-storing well rig lifting system for lifting and lowering a pipe string, comprising:

a well rig having a travelling-beam, a rig frame and a pair of traction ropes each having two ends extending around sheaves carried by said travelling beam;

a hydraulic source for providing high pressure oil including an oil tank, a power machine, a hydraulic pump, and oil pipelines;

an energy-storing system including a high pressure energy-storing oil cylinder connected to said oil tank for storing high pressure oil provided by said hydraulic source, and a high pressure nitrogen gas or air vessel with a constant high pressure in communication with said high pressure energy-storing oil cylinder by a gas pipe for maintaining a substantially constant high pressure in the energy-storing oil cylinder equal to said high pressure in said high pressure gas vessel;

a cylinder group mounted vertically on said rig frame and having chambers and a moving part connected to said travelling beam;

a normal pressure top oil tank mounted above said cylinder group for providing a substantially constant normal pressure oil;

conduits for intercommunication between said chambers and said high pressure energy-storing oil cylinder and between said chambers and said normal pressure top oil tank, respectively; and a pilot valve assembly for selectively controlling said intercommunication so as to provide an appropriate lifting force larger than the gravity of the pipe string to utilize the high pressure oil in the energy-storing oil cylinder to lift the pipe string during a lifting operation, and to provide an appropriate lifting force less than the gravity of the pipe string to lower the pipe string during a lowering operation and to press the high pressure oil back to the energy-storing oil cylinder so as to recover potential energy of the pipe string released during the lowering operation.

2. The well rig lifting system according to claim 1, comprising further a lift-length increasing system composed of said travelling beam, travelling sheaves mounted on said travelling beam, and fixed sheaves mounted on said well rig.

3. The well rig lifting system according to claim 2, wherein one end of each said traction ropes is connected on said travelling beam, and the other end passes through around a set of said travelling sheaves and a set of said fixed sheaves so as to increase the lift-length by 3 times.

4. The well rig lifting system according to claim 2, wherein one end of each said traction ropes is fixed on said well rig frame, and the other end passes around through two sets of said travelling sheaves and one set of said fixed sheaves so as to increase the lift-length by 4 times.

5. The well rig lifting system according to claim 1, wherein said cylinder group is composed of piston cylinders, plunger cylinders, composite cylinders or a combination thereof.

6. The well rig lifting system according to claim 5, wherein said cylinder group may be composed of 1,3,5, or more of said cylinders including a center cylinder and cylinders in pair which are arranged side by side such that said cylinders in pair are symmetrical to said center cylinder, and said cylinders in pair are of same type.

7. The rig lifting system according to claim 2, wherein said energy-storing oil cylinder comprises piston cylinder having a cylinder body and a piston therein, an oil level indicator to show the amount of oil therein, said oil level indicator consists of a slender rod connected to said piston and sticking out of said cylinder body, a magnet mounted on top of said rod, said magnet and said slender rod moving in a copper tube, and a string of magnetic switches disposed on an outside wall of said copper tube, each of which being connected to respective indicating lamps or relays.

8. The well rig lifting system according to claim 1, wherein said cylinder group is composed of piston cylinders, plunger cylinders, composite cylinders or a combination thereof.

9. The well rig lifting system according to claim 8, wherein said cylinder group may be composed of 1,3,5, or more of said cylinders including a center cylinder and cylinders in pair which are arranged side by side such that said cylinders in pair are symmetrical to said center cylinder, and said cylinders in pair are of same type.

10. The well rig lifting system according to claim 1, wherein said power machine is an electric motor or an engine.

11. The rig lifting system according to claim 1, wherein said energy-storing oil cylinder comprises a piston cylinder having a cylinder body and a piston therein, an oil level indicator to show the amount of oil therein, said oil level indicator consists of a slender rod connected to said piston and sticking out of said cylinder body, a magnet mounted on top of said rod, said magnet and said slender rod moving in a copper tube, and a string of magnetic switches disposed on an outside wall of said copper tube, each of which being connected to respective indicating lamps or relays.

12. The well rig lifting system according to claim 1, wherein said pilot valve assembly may be manual, magnetic or pneumatic.

13. A hydraulic energy-storing well rig lifting system for lifting and lowering a pipe string, comprising:

a well rig having a travelling beam, a rig frame and a pair of traction ropes each having two ends extending around sheaves carried by said travelling beam;

a hydraulic source for providing high pressure oil including an oil tank, a power machine, a hydraulic pump, and oil pipelines;

an energy-storing system including a high pressure energy-storing oil cylinder connected to said oil tank for storing high pressure oil provided by said hydraulic source, and a high pressure nitrogen gas or air vessel with a constant high pressure in communication with said high pressure energy-storing oil cylinder by a gas pipe for maintaining a substantially constant high pressure in the energy-storing oil cylinder equal to said high pressure in said high pressure gas vessel;

a composite cylinder mounted vertically on said rig frame and having chambers and a moving part connected to said travelling beam;

a normal pressure top oil tank mounted above said composite cylinder for providing a substantially constant normal pressure oil;

conduits for intercommunication between said chambers and said high pressure energy-storing oil cylinder and between said chambers and said normal pressure top oil tank, respectively; and a pilot valve assembly for selectively controlling said intercommunication so as to provide an appropriate lifting force larger than the gravity of the pipe string to utilize the high pressure oil in the energy-storing oil cylinder to lift the pipe string during a lifting operation, and to provide an appropriate lifting force less than the gravity of the pipe string to lower the pipe string during a lowering operation and to press the high pressure oil back to the energy-storing oil cylinder so as to recover potential energy of the pipe string released during the lowering operation.

14. The well rig lifting system according to claim 13, wherein said composite cylinder consists of a piston cylinder and a plunger cylinder, the piston cylinder having an upper chamber and lower chamber with their respective oil inlets, the plunger cylinder having a plunger and a plunger chamber with an oil inlet, and the piston rod of said piston cylinder being fixedly connected with said plunger.

15. The well rig lifting system according to claim 13, wherein said composite cylinder has an internal guide means.

16. The well rig lifting system according to claim 13, comprising further a lift-length increasing system composed of said travelling beam, travelling sheaves mounted on said travelling beam, and fixed sheaves mounted on said well rig.

17. The well rig lifting system according to claim 16, wherein said composite cylinder consists of a piston cylinder and a plunger cylinder, the piston cylinder having an upper chamber and lower chamber with their respective oil inlets, the plunger cylinder having a plunger and a plunger chamber with an oil inlet, and the piston rod of said piston cylinder being fixedly connected with said plunger.

18. The well rig lifting system according to claim 17, wherein said composite cylinder has an internal guide means,

19. The well rig lifting system according to claim 14, wherein one end of each said traction ropes is connected on said travelling beam, and the other end passes through around a set of said travelling sheaves and a set of said fixed sheaves so as to increase the lift-length by 3 times.

20. The well rig lifting system according to claim 14, wherein one end of each said traction ropes is fixed on said well rig frame, and the other end passes around through two sets of said travelling sheaves and one set of said fixed sheaves so as to increase the lift-length by 4 times.

21. The rig lifting system according to claim 16, wherein said energy-storing oil cylinder comprises a piston cylinder having a cylinder body and a piston therein, an oil level indicator to show the amount of oil therein, said oil level indicator consists of a slender rod connected to said piston and sticking out of said cylinder body, a magnet mounted on top of said rod, said magnet and said slender rod moving in a copper tube, and a string of magnetic switches disposed on an outside wall of said copper tube, each of which being connected to respective indicating lamps or relays.

22. The well rig lifting system according to claim 13, wherein said power machine is an electric motor or an engine.

23. The rig lifting system according to claim 13, wherein said energy-storing oil cylinder comprises a piston cylinder having a cylinder body and a piston therein, an oil level indicator to show the amount of oil therein, said oil level indicator consists of a slender rod connected to said piston and sticking out of said cylinder body, a magnet mounted on top of said rod, said magnet and said slender rod moving in a copper tube, and a string of magnetic switches disposed on an outside wall of said copper tube, each of which being connected to respective indicating lamps or relays.

24. The well rig lifting system according to claim 13, wherein said pilot valve assembly may be manual, magnetic or pneumatic.

25. A hydraulic energy-storing well rig lifting system for lifting and lowering a pipe string, comprising:

a well rig having a travelling beam, a rig frame and a pair of traction ropes each having two ends extending around sheaves carried by said travelling beam;

a hydraulic source for providing high pressure oil including an oil tank, a power machine, a hydraulic pump, and oil pipelines;

an energy-storing system including a high pressure energy-storing oil cylinder connected to said oil tank for storing high pressure oil provided by said hydraulic source, said energy-storing oil cylinder comprising a piston cylinder having a cylinder body and a piston therein, an oil level indicator to show the amount of oil therein, said oil level indicator consisting of a slender rod connected to said piston and sticking out of said cylinder body, a magnet mounted on top of said rod, said magnet and said rod moving in a copper tube, and a string of magnetic switches disposed on an outside wall of said copper tube, each of which being connected to respective indicating lamps or relays; and a high pressure nitrogen gas or air vessel with a constant high pressure in communication with said high pressure energy-storing oil cylinder by a gas pipe for maintaining a substantially constant high pressure in the piston cylinder equal to said high pressure in said high pressure gas vessel;

cylinder means for lifting and lowering said travelling beam, said cylinder means mounted vertically on said rig frame and having chambers and a moving part connected to said travelling beam;

a normal pressure top oil tank mounted above said cylinder means providing a substantially constant normal pressure oil;

conduits for intercommunication between said chambers and said high pressure energy-storing oil cylinder and between said chambers and said normal pressure top oil tank, respectively; and a pilot valve assembly for selectively controlling said intercommunication so as to provide an appropriate lifting force larger than the gravity of the pipe string to utilize the high pressure oil in the energy-storing oil cylinder to lift the pipe string during a lifting operation, and to provide an appropriate lifting force less than the gravity of the pipe string to lower the pipe string during a lowering operation and to press the high pressure oil back to the energy-storing oil cylinder so as to recover potential energy of the pipe string released during the lowering operation.

26. The well rig lifting system according to claim 25, wherein said cylinder means comprises a cylinder group.

27. The well rig lifting system according to claim 25, wherein said cylinder means comprises a composite cylinder.

28. A hydraulic energy-storing well rig lifting system for lifting and lowering a pipe string, comprising:

a well rig having a lift-length increasing system composed of a travelling beam, travelling sheaves mounted on said travelling beam, fixed sheaves mounted on said well rig, a rig frame, and a pair of traction ropes each having two ends extending around said sheaves;

a hydraulic source for providing high pressure oil including an oil tank, a power machine, a hydraulic pump, and oil pipelines;

an energy-storing system including a high pressure energy-storing oil cylinder connected to said oil tank for storing high pressure oil provided by said hydraulic source, said energy-storing oil cylinder comprising a piston cylinder having a cylinder body and a piston therein, an oil level indicator to show the amount of oil therein, said oil level indicator consisting of a slender rod connected to said piston and sticking out of said cylinder body, a magnet mounted on top of said rod, said magnet and said rod moving in a copper tube, and a string of magnetic switches disposed on an outside wall of said copper tube, each of which being connected to respective indicating lamps or relays; and a high pressure nitrogen gas or air vessel with a constant high pressure in communication with said high pressure energy-storing oil cylinder by a gas pipe for maintaining a substantially constant high pressure in the piston cylinder equal to said high pressure in said high pressure gas vessel;

cylinder means for lifting and lowering said travelling beam, said cylinder means mounted vertically on said rig frame and having chambers and a moving part connected to said travelling beam;

a normal pressure top oil tank mounted above said cylinder means providing a substantially constant normal pressure oil;

conduits for intercommunication between said chambers and said high pressure energy-storing oil cylinder and between said chambers and said normal pressure top oil tank, respectively; and a pilot valve assembly for selectively controlling said intercommunication so as to provide an appropriate lifting force larger than the gravity of the pipe string to utilize the high pressure oil in the energy-storing oil cylinder to lift the pipe string during a lifting operation, and to provide an appropriate lifting force less than the gravity of the pipe string to lower the pipe string during a lowering operation and to press the high pressure oil back to the energy-storing oil cylinder so as to recover potential energy of the pipe string released during the lowering operation.

29. The well rig lifting system according to claim 28, wherein said cylinder means comprises a cylinder group.

30. The well rig lifting system according to claim 28, wherein said cylinder means comprises a composite cylinder.

* * * * *